US008210010B2

(12) United States Patent
Higuchi

(10) Patent No.: US 8,210,010 B2
(45) Date of Patent: Jul. 3, 2012

(54) KEY AND LOCKING DEVICE

(75) Inventor: Reiji Higuchi, Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 0 days.

(21) Appl. No.: 13/153,728

(22) Filed: Jun. 6, 2011

(65) Prior Publication Data

US 2011/0302972 A1 Dec. 15, 2011

(30) Foreign Application Priority Data

Jun. 10, 2010 (JP) ..... 2010-133009

(51) Int. Cl.
*E05B 27/04* (2006.01)
*E05B 19/04* (2006.01)

(52) U.S. Cl. ..... 70/492; 70/367; 70/369; 70/409; 70/358; 70/493; 70/419; 70/421

(58) Field of Classification Search ..... 70/361, 70/367, 369, 337–343, 409, 358, 492–495, 70/419, 419 A, 421
See application file for complete search history.

(56) References Cited

U.S. PATENT DOCUMENTS

| | | | | |
|---|---|---|---|---|
| 1,877,404 | A * | 9/1932 | Jacobi | 70/367 |
| 2,047,966 | A * | 7/1936 | Jacobi | 70/492 |
| 2,073,583 | A * | 3/1937 | Olson | 70/368 |
| RE20,865 | E * | 9/1938 | Olson | 70/406 |
| 4,270,372 | A * | 6/1981 | Vonlanthen et al. | 70/406 |
| 4,715,201 | A * | 12/1987 | Craig | 70/369 |
| 6,308,543 | B1 * | 10/2001 | Yoshizawa | 70/492 |
| 7,240,525 | B2 * | 7/2007 | Sevillano Gil | 70/340 |
| 7,690,232 | B2 * | 4/2010 | Klein et al. | 70/409 |
| 2002/0056301 | A1 * | 5/2002 | Theriault et al. | 70/495 |
| 2003/0051521 | A1 * | 3/2003 | Mielonen et al. | 70/365 |
| 2006/0000251 | A1 * | 1/2006 | Ceron et al. | 70/492 |
| 2009/0188286 | A1 * | 7/2009 | Farrenkothen et al. | 70/351 |

FOREIGN PATENT DOCUMENTS

JP 2005-344305 12/2005

* cited by examiner

*Primary Examiner* — Lloyd Gall
*Assistant Examiner* — Ifeolu Adeboyejo
(74) *Attorney, Agent, or Firm* — Roberts Mlotkowski Safran & Cole, P.C.

(57) ABSTRACT

A key includes a body that is plate-shaped to be inserted into a locking device, and a groove that is formed in the body and engages with a plurality of tumblers of the locking device to allow locking and unlocking operations. The groove includes, at a location corresponding to one tumbler of the locking device, a non-engagement part that does not engage with the one tumbler. The groove may include an inside groove, and the non-engagement part may include a notch portion that the inside groove is cut to reach an edge portion of the body.

9 Claims, 5 Drawing Sheets

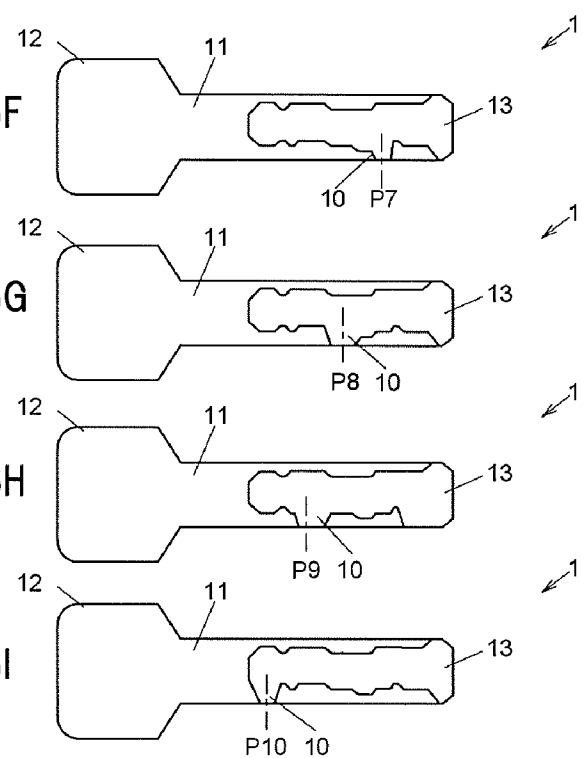
FIG.6F
FIG.6G
FIG.6H
FIG.6I
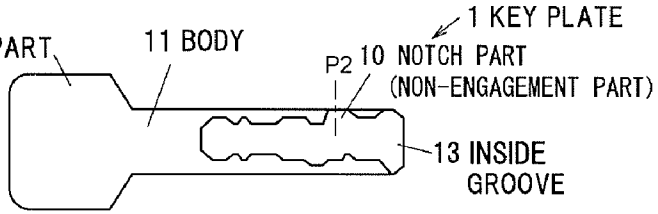
FIG.6A
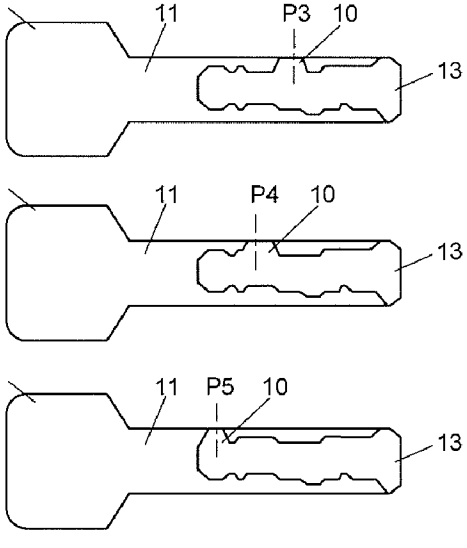
FIG.6B
FIG.6C
FIG.6D
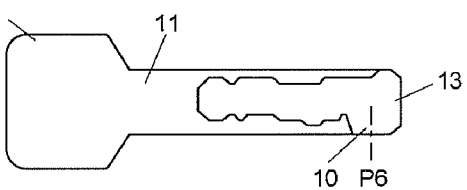
FIG.6E

KEY AND LOCKING DEVICE

The present application is based on Japanese Patent Application No. 2010-133009 filed on Jun. 10, 2010, the entire contents of which are incorporated herein by reference.

BACKGROUND OF THE INVENTION

1. Field of the Invention

This invention relates to a key and a locking device to be operated by the key.

2. Description of the Related Art

As a key for locking or unlocking a locking device such as a cylinder lock, a key plate is used that has a plate body which is shaped like a plate and has an inside groove formed inside a plane thereof. The inside groove type key plate is used such that, by inserting the key plate into a key hole formed on a front surface of a rotor of the cylinder lock, plural tumblers formed in the rotor are engaged with end surfaces of the inside groove, and, when the key plate inserted is a regular key (or authentic key) of the cylinder lock, the tumblers are all drawn from an outer periphery of the rotor to allow the rotation of the rotor (e.g., JP-A-2005-344305).

According to the conventional key and locking device, a key family that has, e.g., ten tumblers, and the inside groove of the key at the position of each tumbler is set to be formed into three steps of a, b and c can have different key patterns of $3^{10}$ in theoretical combination.

SUMMARY OF THE INVENTION

However, in order to prevent a malfunction caused by the key, it is in fact not allowed to produce two keys quite similar to each other, e.g., the two keys being different only in the position of steps at one inside groove. Thus, the combination number of the key patterns available is actually limited.

In order to increase the combination number of the key patterns, it may be assumed that the interval between the tumblers is narrowed to increase the number of tumblers or the number of steps at each inside groove is increased to complicate the inside groove pattern. However, in this case, the accuracy for processing the key and the cylinder lock needs to be enhanced even more.

Where the key and cylinder lock of the same family need to be provided for different device makers and to be used for different models, it is necessary to divide the inside groove patterns of the key into dissimilar groups so as to provide each of them separately. However, it is difficult to quantitatively determine and control the dissimilarity of the inside groove pattern for each key in the same key family, i.e., at a necessary ratio, to what extent the dissimilarity should be ensured in classifying and providing the key.

Accordingly, it is an object of the invention to provide a key and a locking device that allows the key pattern to be easily controlled for each customer while ensuring the sufficient combination number of key patterns without changing the conventional accuracy for processing the inside groove pattern.

(1) According to one embodiment of the invention, a key comprises:

a body that is plate-shaped to be inserted into a locking device; and a groove that is formed in the body and engages with a plurality of tumblers of the locking device to allow locking and unlocking operations, wherein the groove comprises, at a location corresponding to one tumbler of the locking device, a non-engagement part that does not engage with the one tumbler.

In the above embodiment (1) of the invention, the following modifications and changes can be made.

(i) The groove comprises an inside groove, and the non-engagement part comprises a notch portion that the inside groove is cut to reach an edge portion of the body.

(ii) The groove comprises an outside groove, and the non-engagement part comprises a notch portion that the outside groove is cut to reach an edge portion of the body.

(iii) A plurality of the non-engagement parts are formed.

(iv) The key further comprises an other inside groove on an opposite surface and having a pattern vertically symmetrical to a pattern of the inside groove.

(2) According to another embodiment of the invention, a locking device comprises:

a rotor to be turned by a regular key inserted;

a plurality of first tumblers that engage with grooves of the regular key inserted to be drawn from an outer periphery of the rotor; and a second tumbler to be drawn from the outer periphery of the rotor without engaging with the grooves.

In the above embodiment (2) of the invention, the following modifications and changes can be made.

(v) A part of the groove of an irregular key inserted engages with the second tumbler such that the second tumbler projects from the outer periphery of the rotor to restrict the rotor from turning.

(vi) A plurality of the second tumblers are included.

(vii) The locking device further comprises an elastic member to push the second tumbler outward in a radial direction of the rotor.

(viii) The locking device further comprises an elastic member to push the second tumbler inward in a radial direction of the rotor.

POINTS OF THE INVENTION

According to one embodiment of the invention, a key plate and a cylinder lock are constructed such that a rotor of the cylinder lock includes plural tumblers to engage with an inside groove of the key plate to allow the turn of the rotor and at least one tumbler not to engage with the inside groove to allow the turn of the rotor. Thus, it becomes possible to distinguish a combination of keys by whether a notched part (non-engagement part) corresponding to a tumbler is formed in the key plate or not. Therefore, a key plate with the notched part and another key plate without the notched part can be used as a combination of different key patterns (though having apparently similar patterns) that do not cause a malfunction even when all of the patterns of the inside groove at the other positions of the groove are identical between the key plates.

BRIEF DESCRIPTION OF THE DRAWINGS

The preferred embodiments according to the invention will be explained below referring to the drawings, wherein:

FIGS. 6A to 6I are explanatory views schematically exemplifying key plates according to another embodiment of the present invention, the key plates having a structure that a notch part (non-engagement part) is respectively formed at a location corresponding to the locations P2 to P10 shown in FIG. 1.

DETAILED DESCRIPTION OF THE EMBODIMENT

Hereinafter, as a key and a locking device according to an embodiment of the present invention, a key plate 1 used for opening and closing of door of vehicles or the like and used for an ignition key for engine stating or the like, and a cylinder lock 2 corresponding to the key plate 1 will be explained with reference to the drawings.

Key Plate

Figure 1:
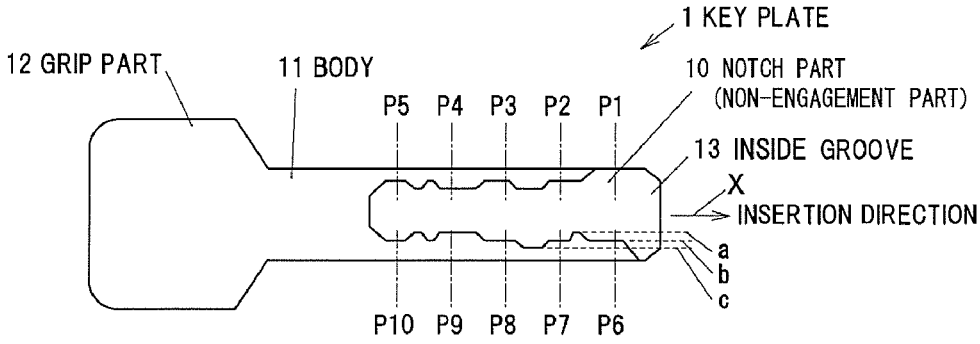
FIG. 1 is a side view schematically showing a key plate according to one embodiment of the present invention.

FIG. 1 is a side view schematically showing a key plate according to one embodiment of the present invention. The key plate 1 is, for example, formed of a copper alloy such as a copper-nickel-zinc alloy (nickel silver) to have a plate-like shape as a whole, and includes a body 11 that is inserted into a cylinder lock 2 described below and a grip part 12 by which an operator inserts and removes the key plate into and from the cylinder lock 2, and by which the operator rotates the key plate.

A predetermined area in the side surface of the body 11 of the key plate 1 is carved to have a predetermined depth such that an inside groove 13 as a groove to function as a key tooth is formed lengthwise along the insertion direction. Further, as shown in FIG. 1, in the key plate 1 according to the embodiment, ten locations P1 to P10 that sandwich the center axis X of the insertion direction from the top and bottom position are respectively allocated and set as locations corresponding to tumblers 201 to 210 described below provided in the cylinder lock 2. In addition, end surfaces of the inside groove 13 in the vertical direction (width direction) in nine locations P2 to P10 except for the location P1 are respectively set at any location of three steps of "a", "b" and "c".

On the other hand, in a part of the location P1, a notch part 10 is formed by that the body 11 is cut toward the edge portion thereof so as to extend the inside groove 13. The notch part 10 is formed as a non-engagement part that has no end surface for engaging with the corresponding tumbler 201.

In addition, in the embodiment, another inside groove 13 that has the same pattern as the inside groove 13 shown in FIG. 1, the pattern thereof being vertically symmetrical to the pattern of the inside groove 13 shown in FIG. 1, is formed on the opposite surface of the key plate 1. Namely, even if the key plate 1 is rotated around the center axis X so that the top and bottom thereof are reversed, the inside groove 13 having the same pattern is always shown in the side surface of the body 11, thereby the cylinder lock 2 can be operated regardless of a state about the top and bottom of the body 11 at the time of insertion.

Cylinder Lock

Figure 2:
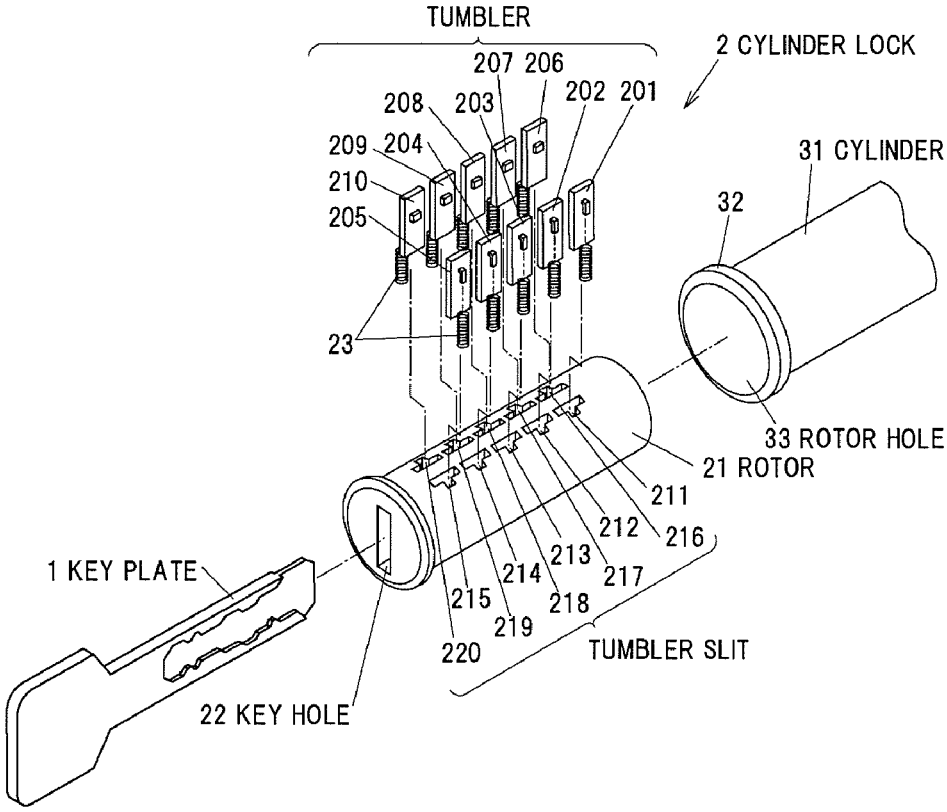
FIG. 2 is an exploded perspective view schematically showing the key plate shown in FIG. 1 and a cylinder lock corresponding to the key plate.

Next, the structure of the cylinder lock 2 that is locked and unlocked by the key plate 1 will be explained. FIG. 2 is an exploded perspective view schematically showing the key plate 1 shown in FIG. 1 and the cylinder lock 2 corresponding to the key plate 1. The cylinder lock 2 includes a rotor 21 having a circular cylindrical shape and a cylinder 31 having a tubular shape that houses the rotor 21 rotatably.

A front surface of the rotor 21 is exposed exteriorly in a state that it is housed in the cylinder 31, and a key hole 22 into which the key plate 1 is inserted is formed from the front surface to the inside in the axis direction. In addition, in the rotor 21, tumbler slits 211 to 220 for housing tumblers 201 to 210 are formed so as to be arranged at ten sites in total of which every five sites are side by side in two rows along the axis direction. The tumbler slits 211 to 215 shown on the right and near side in FIG. 2 are formed at the locations corresponding to the above-mentioned locations P1 to P5 of the key plate 1 in a state that the key plate 1 is inserted from the key hole 22 and the tumbler slits 216 to 220 shown on the left and back side are formed at the locations corresponding to the above-mentioned locations P6 to P10. In addition, the tumbler slits 211 to 220 are formed so as to pass through the rotor 21 from the upper surface part to the lower surface part thereof.

A head part 32 having a flange-like shape is formed on the front surface of the cylinder 31, and a rotor hole 33 for housing the rotor 21 slidably is formed on the front surface of the head part 32 by boring.

Figure 3:
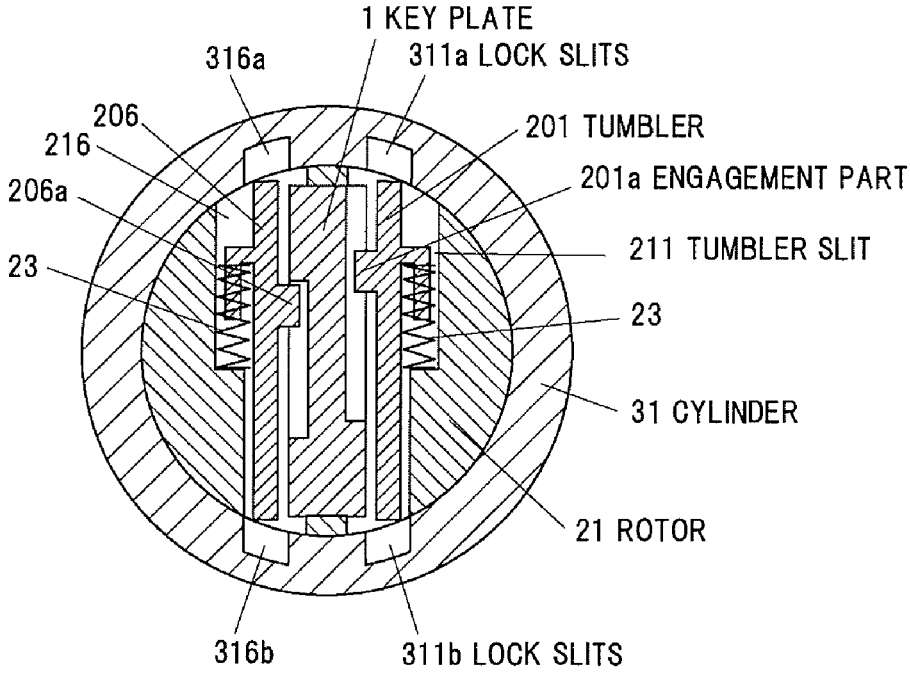
FIG. 3 is a longitudinal cross-sectional view schematically showing the cylinder lock taken along the line formed by combining locations P1 and P6 of the key plate shown in FIG. 1, and FIG. 3 exemplifies a state that a regular key plate is inserted.
Figure 4:
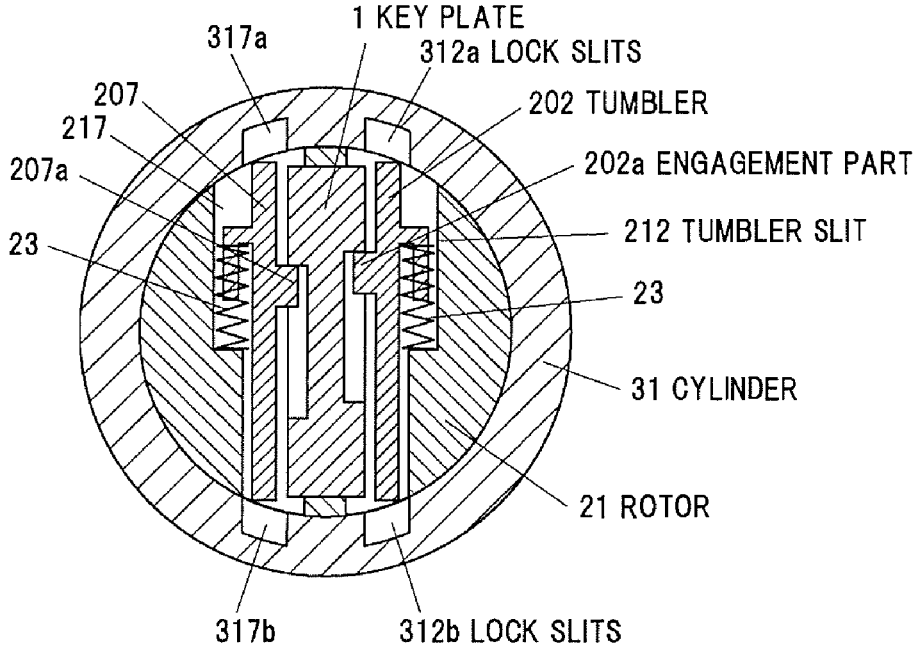
FIG. 4 is a longitudinal cross-sectional view schematically showing the cylinder lock taken along the line formed by combining locations P2 and P7 of the key plate shown in FIG. 1, and FIG. 4 exemplifies a state that a regular key plate is inserted.

FIG. 3 is a longitudinal cross-sectional view schematically showing the cylinder lock 2 taken along the line formed by combining locations P1 and P6 of the key plate 1 shown in FIG. 1. In addition, FIG. 4 is a longitudinal cross-sectional view schematically showing the cylinder lock 2 taken along the line formed by combining locations P2 and P7 of the key plate 1 shown in FIG. 1. Further, FIG. 3 and FIG. 4 show a case that a regular key plate 1 corresponding to the cylinder lock 2 is inserted.

With reference to FIG. 3 and FIG. 4, lock slits 311*a*, 311*b*, 312*a*, 312*b*, . . . , 316*a*, 316*b*, 317*a*, 317*b*, . . . are formed by being scraped out in the locations corresponding to the tumbler slits 211, 212, . . . in an inner periphery of the rotor hole 33.

On the other hand, the tumblers 201, 202, . . . , 206, 207, . . . that are housed in the tumbler slits 211, 212, . . . , 216, 217, . . . of the rotor 21 have engagement parts 201*a*, 202*a*, . . . , 206*a*, 207*a*, . . . that are formed so as to project toward the key plate 1 respectively, and are always biased toward the diameter direction (upper direction in FIG. 3 and FIG. 4) of the rotor 21 by coil springs 23, 23, . . . .

The tumblers 201, 202, . . . , 206, 207, . . . are biased by the coil springs 23, 23, . . . , thereby in a state that the key plate 1 is not inserted, upper end portions of the tumblers 202, . . . , 206, 207, . . . are inserted into the lock slits 312*a*, . . . , 316*a*, 317*a*, . . . respectively, so that the rotor 21 is inhibited (locked) from rotating to cylinder 31. However, the tumbler 201 is not inserted into the lock slit 311*a* even in a state that the key plate 1 is not inserted.

As shown in FIG. 3 and FIG. 4, in case that the regular key plate 1 is inserted, each of the engagement parts 202*a*, . . . , 206*a*, 207*a*, . . . of the tumblers 202, . . . , 206, 207, . . . except for the tumbler 201 engages with the end surfaces in the corresponding locations P2, . . . , P6, P7, . . . of the inside groove 13 of the key plate 1, so that all of the tumblers 201 to 210 evacuate from the outer periphery of the rotor 21. Thereby, the rotor 21 becomes rotatable in the cylinder 31 so that locking operation and unlocking operation become possible.

Figure 5:
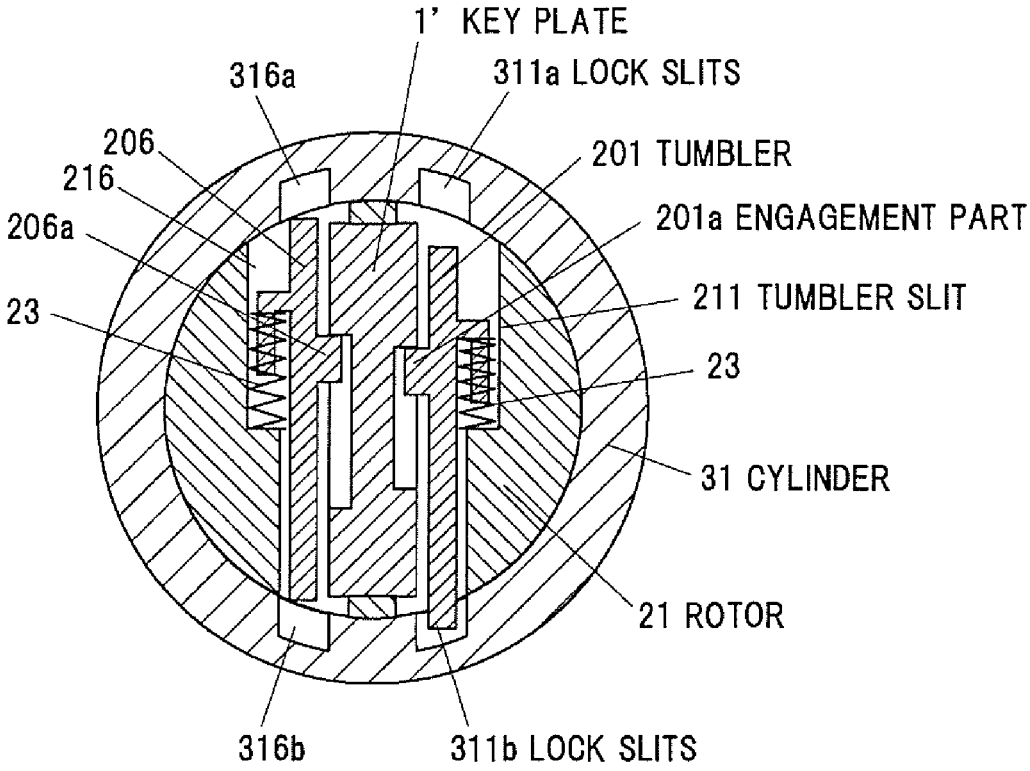
FIG. 5 is a longitudinal cross-sectional view schematically showing the cylinder lock taken along the line corresponding to the locations P1 and P6 of the key plate shown in FIG. 1, and FIG. 5 exemplifies a state that an irregular key plate is inserted.

FIG. 5 is a longitudinal cross-sectional view schematically showing the cylinder lock 2 taken along the line corresponding to the locations P1 and P6 of the key plate 1 shown in FIG. 1 as well as FIG. 3. However, FIG. 5 exemplifies a state that an irregular key plate 1' not corresponding to the cylinder lock 2 is inserted.

As shown in FIG. 5, when the irregular key plate 1' having a structure that any step of "a", "b" and "c" is formed in the inside groove 13 corresponding to the location P1 is inserted into the cylinder lock 2, the engagement part 201*a* of the tumbler 201 corresponding to the location P1 engages with the inside groove 13 of the key plate 1'. At this time, the tumbler 201 is pushed down so that the lower end portion of thereof is inserted into the lock slit 311*b* of the cylinder 31. Thereby, the rotor 21 is locked, so that rotation operation is inhibited.

As described above, according to the key plate 1 and the cylinder lock 2 of the embodiment, a structure is provided, that a plurality of tumblers 201 to 210 allowing the rotation operation by engaging with the inside groove 13 of the key plate 1 and at least one tumbler 201 allowing the rotation operation by not engaging with the inside groove 13 are formed in the rotor 21 of the cylinder lock 2. Thereby, it becomes possible to differentiate combinations of key due to whether the notch part (non-engagement part) 10 corresponding to the tumbler 201 is formed in the key plate 1 or not. The key plate 1 having the notch part 10 and the key plate 1 not having the notch part 10 can be set as a combination of different key pattern that does not malfunction with each other even if all of the patterns of the inside groove 13 in the other locations P2 to P10 correspond to each other.

Therefore, for example, by that the key plate 1 and the cylinder lock 2 included in the same family that have the same number of the tumblers 201 and the same number of steps of the inside groove 13 are separated due to the difference in existence or non-existence of the notch part (non-engagement part) of the inside groove, they can be provided separately as a product for different objective device or different maker. Accordingly, the number of combination of the key pattern sufficient for not causing malfunction in the same key family can be set without complicating the conventional inside groove pattern. In addition, the key pattern to each different customer can be easily controlled.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

Figure 7:
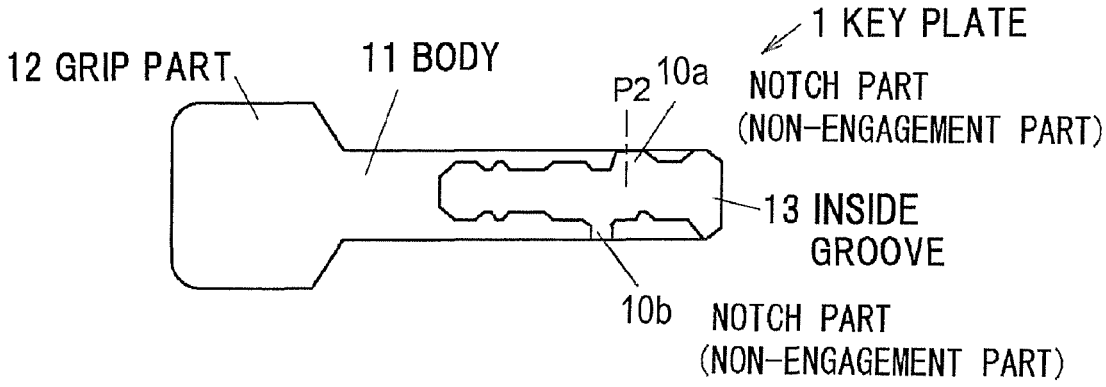
FIG. 7 is a side view schematically showing a key plate according to another embodiment of the present invention having two non-engagement portions.

For example, although the embodiment has been explained by a key plate of an inside groove type, the present invention can be also applied to a key plate with an outside groove (i.e., a groove externally formed opposite the inside groove). Further, FIGS. 6A to 6I are explanatory views schematically exemplifying key plates according to another embodiment of the present invention, the key plates having a structure that a notch part (non-engagement part) is respectively formed at a location corresponding to the locations P2 to P10. As shown in FIGS. 6A to 6I, the notch part as a non-engagement part can be formed at arbitrary locations corresponding to the tumbler of the cylinder lock, and can be also formed in a plurality of sites instead of limiting to one site. Finally, as shown in FIG. 7, the body 11 of the key plate 1 may have two or more non-engagement parts 10*a*, 10*b* which, when the body 11 is inserted into the cylinder lock 2, do not engage two of the tumblers 201, 203, (referred to as "second tumblers" in the claims) thereby allowing the rotor 21 to rotate within the cylinder 31.

What is claimed is:

1. A locking device, comprising:

a rotor that is rotatable within a cylinder and which includes a plurality of first tumblers and at least one second tumbler;

a key having a body that is plate-shaped and insertable into the rotor; and a groove that is formed in the body that engages with and moves the plurality of first tumblers of the locking device when the key is inserted into the rotor to allow locking and unlocking operations, wherein the groove includes, at a location corresponding to a second tumbler of the locking device, a non-engagement part that does not engage with the second tumbler, such that the second tumbler allows the rotor to rotate when the non-engagement part of the key groove is aligned therewith in non-engagement, and prevents the rotor from rotating if the groove engages an engagement part of the second tumbler and moves the second tumbler.

2. The locking device according to claim 1, wherein the groove comprises an inside groove, and the non-engagement part comprises a notch portion cut in the inside groove that extends to an edge portion of the body.

3. The locking device according to claim 1, wherein the plurality of first tumblers that engage the groove of the key inserted into the rotor are moved so as to be withdrawn from an outer periphery of the rotor; and the second tumbler is withdrawn from the outer periphery of the rotor when it does not engage with the groove but projects from the outer periphery if it engages with the groove.

4. The locking device according to claim 1, wherein a part of a groove of an irregular key inserted into the rotor engages with the second tumbler such that the second tumbler projects from the outer periphery of the rotor to prevent the rotor from turning.

5. The locking device according to claim 1, wherein the groove comprises an outside groove, and the non-engagement part comprises a notch portion cut in the outside groove that extends to an edge portion of the body.

6. The locking device according to claim 1, wherein a plurality of non-engagement parts are formed in the groove, each of which is aligned with a second tumbler that allows the rotor to rotate when a non-engagement part of the key groove is aligned therewith in non-engagement, and prevents the rotor from rotating if the engagement part of the groove engages and moves it.

7. The locking device according to claim 2, further comprising another inside groove on an opposite surface of the key and on an opposite side of said opposite surface and having a pattern vertically symmetrical to a pattern of the inside groove.

8. The locking device according to claim 3, wherein a plurality of the second tumblers are included.

9. The locking device according to claim 3, further comprising a resilient member that pushes the second tumbler outward in a radial direction of the rotor.

* * * * *